US005221155A

United States Patent [19]

Neil

[11] Patent Number: 5,221,155

[45] Date of Patent: Jun. 22, 1993

[54] VERTICALLY ADJUSTABLE MANHOLE ADJUSTING RING SECTION

[75] Inventor: Ronald E. Neil, Pella, Iowa

[73] Assignee: Umar, Inc., Pella, Iowa

[21] Appl. No.: 765,019

[22] Filed: Sep. 24, 1991

[51] Int. Cl.[5] ..... E02D 29/14; E06B 1/04

[52] U.S. Cl. ..... 404/26; 52/21

[58] Field of Search ..... 404/25-26; 49/21, 34, 41, 505; 52/19-21

[56] References Cited

U.S. PATENT DOCUMENTS

| | | | |
|---|---|---|---|
| 2,109,287 | 2/1938 | Elkington | 94/34 |
| 2,254,668 | 9/1941 | Tomek | 404/26 |
| 3,218,943 | 11/1965 | Bowman | 94/34 |
| 3,294,000 | 12/1966 | Pelsue | 404/26 |
| 3,773,428 | 11/1973 | Bowman | 94/34 |
| 4,187,647 | 2/1980 | Hall | 52/19 |
| 4,188,151 | 2/1980 | Hall | 404/26 |
| 4,281,944 | 8/1981 | Bowman | 404/26 |
| 4,582,450 | 4/1986 | Neil | 404/22 |
| 4,690,584 | 9/1987 | LeBaron | 404/26 |
| 4,976,568 | 12/1990 | Hess | 404/26 |
| 4,995,757 | 2/1991 | Prescott | 404/26 |
| 5,078,539 | 1/1992 | Claing | 404/26 |

FOREIGN PATENT DOCUMENTS

| | | |
|---|---|---|
| 19453 | 2/1977 | Japan . |
| 503412 | 5/1939 | United Kingdom . |

*Primary Examiner*—Ramon S. Britts
*Assistant Examiner*—Nancy P. Connolly
*Attorney, Agent, or Firm*—Zarley, McKee, Thomte, Voorhees & Sease

[57] ABSTRACT

A manhole adjusting ring includes ring sections each having a vertically disposed connecting plate which is selected from an inventory of different sized connecting plates to interconnect an outer ring portion to an inner ring portion. The resulting adjusting ring section will compliment the dimensions of the manhole casting including the distance from the top peripheral edge to the casting ledge on the inner wall.

5 Claims, 1 Drawing Sheet

VERTICALLY ADJUSTABLE MANHOLE ADJUSTING RING SECTION

BACKGROUND OF THE INVENTION

Generally, manhole covers and storm sewer grates are supported by a metal casting which is fixed in the road such that the cover or grate is at the same elevation as the road surface. However, when the road is resurfaced or repaired, the casting is considerably below the level of the new road surface such that the cover or grate is also not level with the new surface, creating driving hazards.

In my U.S. Pat. No. 4,582,450 issued Apr. 15, 1986, an adjustment ring is disclosed which can be positioned on the old casting to raise the manhole cover or storm grate to the same elevation as the resurfaced road.

It has been seen that further adjustment capabilities for the adjusting ring are needed. Specifically, castings vary in their size as to the distance between the top peripheral edge and the support shoulder on the inner wall. Accommodation for this need previously would involve selecting from an inventory of different sized rings an adjusting ring which is appropriately sized to fit the casting.

It is thus seen that what is needed is an adjustment ring section which includes common components which when assembled can provide an adjustment ring of any desired height to matingly fit the requirements of a given manhole casting.

SUMMARY OF THE INVENTION

The manhole adjusting ring section includes separate and distinct outer and inner ring portions which are adapted to be interconnected by the appropriately sized connecting plate to give a ring section that will matingly match the dimensions of the casting regarding the distance from the top peripheral edge to the support ledge on the inner wall. Such an adjustment ring requires only an inventory of connecting plates of different vertical heights to allow the ring section to match up with any given manhole casting.

DESCRIPTION OF PREFERRED EMBODIMENT

Figure 1:
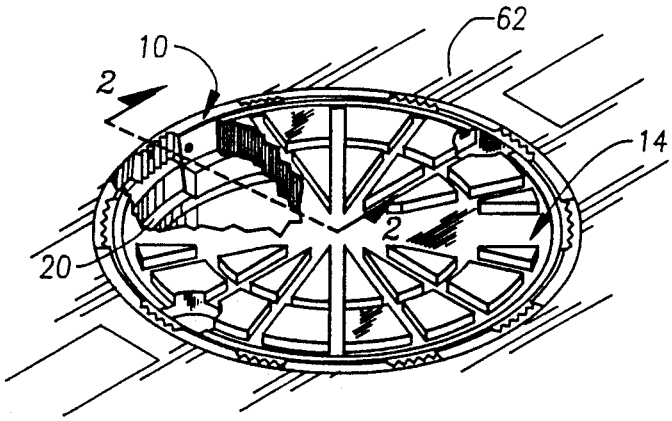
FIG. 1 is a fragmentary perspective view of a manhole adjustment ring in use with a standard manhole cover.
Figure 4:
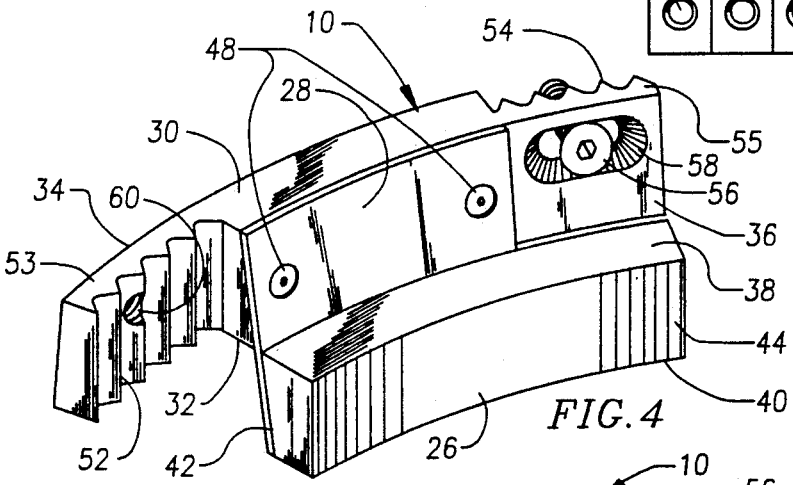
FIG. 4 is a perspective view of a vertically adjustable manhole adjusting ring section using one of the connecting plates of FIG. 3.
Figure 5:
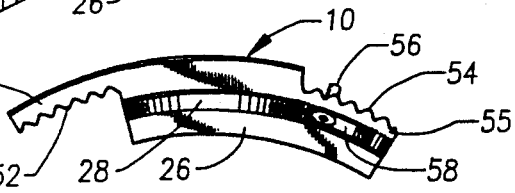
FIG. 5 is a top plan view thereof.
Figure 6:
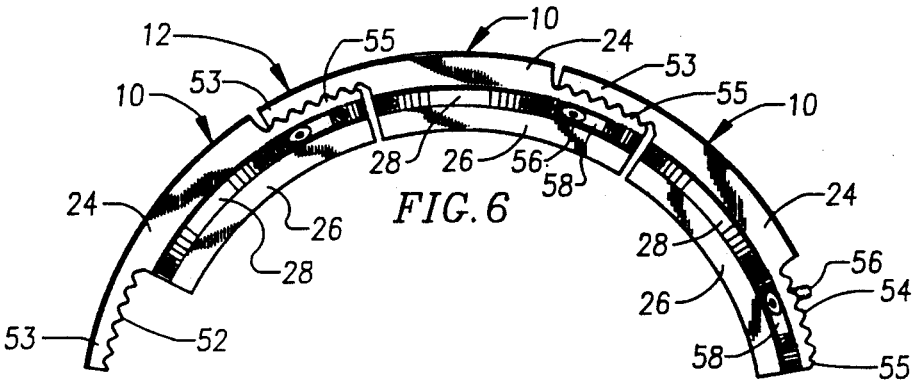
FIG. 6 is a view similar to FIG. 5 but illustrating a plurality of main sections interconnected.

The vertically adjustable manhole adjusting ring section of this invention is referred to generally in FIG. 4 by the reference numeral 10. The adjustment ring 10 is seen in FIG. 6 as one of several sections 10 interconnected to form an endless adjustment ring 12 which supports a manhole cover 14 as seen in FIG. 1.

Figure 2:
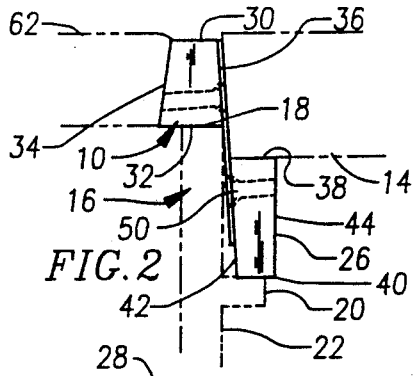
FIG. 2 is a cross-sectional view taken along line 2—2 in FIG. 1.

The typical manhole as seen in FIG. 2 includes a casting 16 having a top peripheral edge 18 and a ledge 20 on the inner wall 22.

The adjustment ring section 10 includes an outer ring portion 24 and an inner ring portion 26 interconnected by a connecting plate 28. The outer ring portion 24 includes an upper surface 30, lower surface 32, outer wall 34 and inner wall 36. The inner ring portion 26 includes an upper surface 38, lower surface 40, outer wall 42 and inner wall 44.

The connecting plate 28 is provided with four screw openings 46 through which screws 48 are received for connecting the plate to the outer ring portion 24 on the inner wall 36. Screws 50 as seen in FIG. 2 interconnect the connecting plate 28 to the outer wall 42 of the inner ring portion 26.

Figure 3:
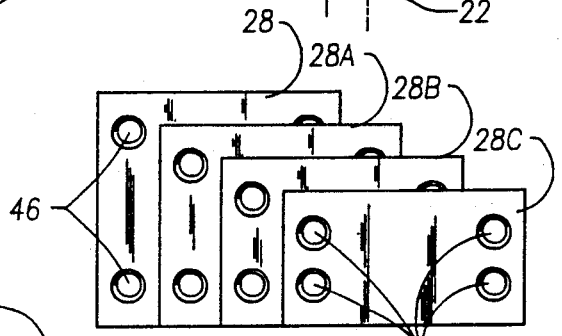
FIG. 3 is a front elevational view of a series of different sized connecting plates.

Connecting plates 28, 28A, 28B and 28C are shown in FIG. 3 differing only in their vertical height dimension.

The outer ring portion 24 includes inwardly facing vertically disposed teeth 52 on one end 53 and outwardly facing teeth 54 on the opposite end 55 as seen in FIG. 6 which intermesh on overlapping ends 53 and 55 of adjustment ring sections 10. Screws 56 extend through elongated openings 58 in the ends 55 and are received in threaded holes 60 in end portions 53.

Thus in operation it is seen that a determination is made as to the vertical distance between the top edge 18 of the casting 16 and the casting ledge 20 as seen in FIG. 2. With this distance in mind a connecting plate 28 having the appropriate height is selected for interconnecting the outer ring portion 24 to the inner ring portion 26. It is thus seen that an inventory of common component parts 24 and 26 is possible which require for assembly selecting the appropriately sized connecting plate 28. It is obvious that it is much simpler to maintain an inventory of connecting plates 28 than it is to inventory the entire adjustment ring section 10 in varying sizes. In use as seen in FIG. 2, with the appropriately sized adjustment ring 10, the manhole cover 14 will be coplanar with the upper casting surface 30 and the top of the resurfacing material 62. The lower surface 32 of the outer ring portion 24 rests on the top peripheral edge 18 of the casting 16 while the lower surface 40 of the inner ring portion 26 engages the casting ledge 20.

What is claimed is:

1. A vertically adjustable manhole adjusting ring section comprising;

an outer ring portion having inner and outer walls, top and bottom surfaces, and opposite ends, an inner ring portion having inner and outer walls, top and bottom surfaces, and opposite ends, and the inner wall of said outer ring and the outer wall of said inner ring being substantially coplanar, a flat connecting plate having upper and lower plate portions, said upper plate portion being flat against the inner wall of the outer ring, and the lower plate portion being flat against the outer wall of the inner ring, and said connecting plate having an appropriate height for said adjusting ring section to matingly engage a casting with said lower surface of said outer ring portion engaging the top edge of said casting and the lower surface of said inner ring portion engaging an inner ledge of said casting, and removable fasteners connecting said upper plate portion to said inner wall and said lower plate portion to said outer wall.

2. The structure of claim 1 wherein said removable fasteners are screws.

3. The method of matching a manhole casting, lid and adjusting ring section comprising the steps of, providing an inventory of adjusting ring outer ring portions, inner ring portions, and connecting plates having varying heights, selecting the desired outer and inner ring portions, selecting a connecting plate having the appropriate height from said inventory of connecting plates for interconnecting the adjusting ring section outer and inner ring portions for said outer ring portion to matingly engage said casting with the lower surface of the outer ring portion engaging the top edge of the casting and the lower surface of said inner ring portion engaging the inner ledge of the casting, and fastening with removable fasteners the selected connecting plate to the inner wall of said outer ring portion and the outer wall of the inner ring portion.

4. The method of claim 3 and the step of positioning the outer and inner ring portions with the inner wall of the outer ring and the outer wall of the inner ring being substantially coplanar.

5. The method of claim 4 and the step of placing the connecting plate flat against the inner wall of the outer ring portion and the outer wall of the inner ring portion.

* * * * *